US010139210B2

(12) United States Patent
Solomon

(10) Patent No.: US 10,139,210 B2
(45) Date of Patent: Nov. 27, 2018

(54) EXTERNAL BULLET STORAGE

(71) Applicant: Robert Solomon, East Parsonfield, ME (US)

(72) Inventor: Robert Solomon, East Parsonfield, ME (US)

( * ) Notice: Subject to any disclaimer, the term of this patent is extended or adjusted under 35 U.S.C. 154(b) by 2 days.

(21) Appl. No.: 14/049,789

(22) Filed: Oct. 9, 2013

(65) Prior Publication Data

US 2015/0247691 A1 Sep. 3, 2015

Related U.S. Application Data

(60) Provisional application No. 61/712,435, filed on Oct. 11, 2012.

(51) Int. Cl.
*F42B 39/02* (2006.01)
*F41A 9/65* (2006.01)

(52) U.S. Cl.
CPC ..... *F42B 39/02* (2013.01); *F41A 9/65* (2013.01)

(58) Field of Classification Search
CPC ..... F42B 39/02; F42B 39/002; F42B 39/26; F41A 9/65; F41A 9/84; F41A 9/61; F41A 9/63; F41A 9/66; F41A 9/68; F41A 11/00; F41A 9/24; F41A 9/31; F41A 9/70; F41A 35/00; F41A 9/62; F41A 9/69; F41A 9/72; Y10S 224/931; F41C 33/04; F41C 27/00; F41C 23/18; B25C 1/163
USPC ..... 42/87, 71.01; 89/32.2, 34
See application file for complete search history.

(56) References Cited

U.S. PATENT DOCUMENTS 136,987 A * 3/1873 Gaines ..... A45F 5/02 224/247
144,594 A * 11/1873 Black ..... A41D 1/04 2/102
160,420 A * 3/1875 Goss ..... A45F 5/02 224/678
268,749 A * 12/1882 Thom ..... B43L 7/02 33/468
299,736 A * 6/1884 Carlin ..... A45F 5/02 224/247
507,836 A * 10/1893 Orndorff ..... D03D 11/02 139/390
549,710 A * 11/1895 Evans ..... A45F 5/02 224/678
863,798 A * 8/1907 Hodges ..... F41A 9/84 42/87

(Continued)

*Primary Examiner* — Troy Chambers
*Assistant Examiner* — Bridget A Cochran
(74) *Attorney, Agent, or Firm* — Jeffrey Joyce; Patricia Mathers

(57) ABSTRACT

An external storage device for holding bullets. The storage device snaps into a conventional lower receive on the firearm. The bullets are mounted in slots that are provided on the outside of the storage device. This device is intended for use with very large caliber bullets, such as .50 caliber bullets, for which there is no ammunition clip. The external storage device may also be constructed as an ammunition magazine that automatically loads bullets into the firearm, whereby the ammunition magazine is modified to include bullet storage slots on external surfaces that remain exposed when the magazine is inserted into lower receiver. The external storage device may also be constructed as a sleeve that fits over a conventional ammunition clip.

5 Claims, 4 Drawing Sheets

(56) References Cited

U.S. PATENT DOCUMENTS 1,664,255 A * 3/1928 Lesser ..... A42B 1/24 2/195.5
1,693,289 A * 11/1928 Warren ..... F41C 23/02 42/71.01
2,014,177 A * 9/1935 Herlach et al. ..... F41A 9/67 42/50
2,017,988 A * 10/1935 Pedersen ..... F41A 9/84 42/87
2,432,802 A * 12/1947 Reynolds ..... F42B 39/26 206/3
2,477,806 A * 8/1949 Isaacson ..... F41A 9/83 224/247
2,481,726 A * 9/1949 D Assis-Fonseca ..... F41A 9/29 89/33.2
2,628,749 A * 2/1953 Ryden ..... A01M 31/006 224/223
2,783,570 A * 3/1957 Kunz ..... F41A 9/66 42/18
2,856,720 A * 10/1958 Kunz ..... F41A 9/84 42/87
2,887,811 A * 5/1959 Johnson, Jr. ..... F41A 9/84 42/87
2,910,795 A * 11/1959 Agren ..... F41A 9/67 206/3
2,961,927 A * 11/1960 Dufour ..... E05O 17/22 89/1.816
3,143,820 A * 8/1964 Lucianetti ..... F41A 9/65 42/50
3,153,500 A * 10/1964 Pachmayr ..... F42B 39/02 206/3
3,222,810 A * 12/1965 Musgrave ..... F41A 9/84 42/50
3,242,609 A * 3/1966 Koistinen ..... F41A 9/83 42/50
3,538,636 A * 11/1970 Roth ..... F41A 9/84 42/87
3,618,453 A * 11/1971 Cornelison ..... F41A 9/02 89/1.804
3,669,249 A * 6/1972 Foster ..... F41A 9/84 206/3
3,744,170 A * 7/1973 Jensen ..... F42B 39/02 42/87
3,789,531 A * 2/1974 Kersten ..... F42B 39/00 206/3
4,004,683 A * 1/1977 Pomeroy ..... B65D 83/0472 206/3
4,109,401 A * 8/1978 Musgrave ..... F41A 9/62 42/1.01
4,268,627 A * 5/1981 Sera ..... C07D 471/04 430/495.1
4,484,404 A * 11/1984 Johnson ..... F41A 17/38 42/90
4,614,052 A * 9/1986 Brown ..... F41A 9/83 42/50
4,628,627 A * 12/1986 Johnson ..... F41A 9/63 42/90
4,707,941 A * 11/1987 Eastman ..... F41A 9/68 42/49.02
4,724,739 A * 2/1988 Heberlein ..... F42B 39/082 89/33.2
4,727,890 A * 3/1988 Vincent ..... B60N 3/12 131/329
4,843,649 A * 7/1989 Jewell ..... F42B 39/02 2/94
4,949,888 A * 8/1990 May ..... F42B 39/02 2/328
4,953,765 A * 9/1990 Little ..... A41D 13/0012 206/373
D325,952 S * 5/1992 Moore ..... D22/108
5,121,564 A * 6/1992 Story ..... F41C 27/00 224/239
5,127,565 A * 7/1992 Grant ..... A41D 13/0012 2/102
5,159,136 A * 10/1992 Marsh ..... F41C 23/22 42/71.01
5,174,482 A * 12/1992 Rogers ..... F42B 39/02 221/185
5,279,059 A * 1/1994 Howard ..... F41A 9/63 42/50
5,370,288 A * 12/1994 Field ..... A45C 13/02 211/60.1
D363,525 S * 10/1995 Montefusco ..... D22/108
5,460,305 A * 10/1995 Ahearn ..... B25H 5/00 211/DIG. 1
5,813,157 A * 9/1998 Scott ..... F41C 23/22 42/71.01
5,924,613 A * 7/1999 Johnson ..... A45F 5/02 2/94
D413,644 S * 9/1999 Carver ..... D22/108
6,050,464 A * 4/2000 Ramsey, Sr. ..... F41A 9/61 206/3
6,176,407 B1 * 1/2001 Jones ..... F42B 39/02 224/223
6,202,908 B1 * 3/2001 Groover ..... F42B 39/02 224/236
6,212,815 B1 * 4/2001 Fitzpatrick ..... F41A 9/65 224/196
6,244,486 B1 * 6/2001 Holland ..... A45F 5/02 224/223
6,253,481 B1 * 7/2001 Melby ..... F41A 9/72 224/251
D463,117 S * 9/2002 Carter ..... D3/221
6,481,136 B1 * 11/2002 Fitzpartick ..... F41A 9/65 42/18
6,668,479 B1 * 12/2003 Obong ..... F41A 9/68 206/3
6,799,500 B1 * 10/2004 Kulikowski ..... F41A 9/79 89/1.1
6,817,135 B1 * 11/2004 Jackson ..... F42B 39/002 206/3
6,874,618 B1 * 4/2005 Cragg ..... F42B 39/02 206/3
7,093,386 B1 * 8/2006 Vieweg ..... F41A 9/65 42/7
7,225,574 B2 * 6/2007 Crandall ..... F41A 9/47 42/10
7,275,639 B1 * 10/2007 Sillin ..... F41C 33/06 206/3
7,562,482 B1 * 7/2009 Johnson ..... F41A 9/63 42/50
7,568,421 B2 * 8/2009 Cummings ..... F41A 9/31 42/87
7,690,290 B2 * 4/2010 Oehri ..... B25C 1/163 102/281
7,805,873 B2 * 10/2010 Bentley ..... F42B 39/02 42/71.01
7,908,957 B1 * 3/2011 Leung ..... F41A 27/02 89/33.14
8,011,544 B1 * 9/2011 Howell ..... A45F 5/02 224/196
D661,770 S * 6/2012 Thunberg ..... D22/115
D680,325 S * 4/2013 Froyd ..... D3/222
8,479,430 B1 * 7/2013 Masten ..... F41C 23/22 42/72
8,528,245 B2 * 9/2013 Chvala ..... F42B 39/002 224/251
8,584,389 B2 * 11/2013 Godard ..... F42B 39/02 42/71.01
D716,544 S * 11/2014 Fahnholz ..... D3/225
8,931,633 B2 * 1/2015 Martin, III ..... F41A 9/85 206/3
8,960,497 B2 * 2/2015 Lefeber ..... F42B 39/26 221/197
D730,475 S * 5/2015 Iannello ..... D22/108
9,109,847 B1 * 8/2015 Clinton, III ..... F41A 9/01

(56) References Cited

U.S. PATENT DOCUMENTS

D753,260 S * 4/2016 Solovov, Jr. ..... D22/116
D759,354 S * 6/2016 Nail ..... D2/866
9,733,053 B2 * 8/2017 Olroyd ..... F42B 39/02
2004/0060220 A1 * 4/2004 Peddie ..... F41C 23/22 42/71.01
2006/0113347 A1 * 6/2006 Link ..... F42B 39/02 224/674
2006/0242877 A1 * 11/2006 Clifton, Jr. ..... F41A 9/63 42/49.01
2007/0059114 A1 * 3/2007 Grimes, II ..... B25F 5/029 408/238
2010/0006616 A1 * 1/2010 Orr ..... F41B 11/50 224/682
2010/0101445 A1 * 4/2010 Garg ..... F41A 9/65 102/502
2010/0219217 A1 * 9/2010 Andochick ..... A45F 5/02 224/250
2012/0137564 A1 * 6/2012 Swenson, III ..... F41A 9/63 42/87
2012/0222343 A1 * 9/2012 Kim ..... F41A 9/83 42/88
2012/0285066 A1 * 11/2012 Chvala ..... F42B 39/002 42/90
2012/0311911 A1 * 12/2012 Nelson ..... F41A 9/65 42/90
2013/0074392 A1 * 3/2013 McCaffery ..... F42B 39/02 42/90
2013/0334073 A1 * 12/2013 Frye ..... F42B 39/00 206/38
2013/0341210 A1 * 12/2013 Goodwin ..... F42B 39/26 206/3
2014/0124387 A1 * 5/2014 Iannello ..... F42B 39/02 206/3
2014/0190058 A1 * 7/2014 Ballard ..... F42B 39/26 42/90
2014/0298704 A1 * 10/2014 Niccum ..... F41A 9/83 42/87
2014/0311009 A1 * 10/2014 Anglin ..... F41G 1/34 42/90
2014/0317985 A1 * 10/2014 Cauley, Jr. ..... F41A 9/83 42/87

* cited by examiner

EXTERNAL BULLET STORAGE

BACKGROUND INFORMATION

Field of the Invention

The invention relates to ammunition magazines for repeating firearms. More particularly, the invention relates to an external storage device in the shape of an ammunition magazine.

Discussion of Prior Art

Assault rifles or repeating firearms, such as, for example, the M1, M14, M16, BMG50 assault rifles, AK 47s, etc., are frequently provided as modular assemblies, so that the user has the option of selecting a different barrel size for a particular caliber bullet, changing the butt stock, adding a scope, etc. FIGS. 1 and 2 illustrate a conventional assault rifle with a lower receiver R and an ammunition magazine M. A typical and distinctive feature of the assault rifle is the ammunition magazine, also frequently referred to as a "gun clip," that is inserted into the lower receiver of the firearm.

The BMG50 Sniper Rifle, shown in FIG. 1A, uses .50 caliber bullets, which are manually loaded into the chamber of the firearm, i.e., the rifle is used without an ammunition magazine. The look of the firearm appears odd or incomplete to many users and collectors, because the lower receiver R extends down from the body of the rifle, but without the magazine. Many users have been known to modify the lower receiver, so that it blends in more with the lines of the rifle. Also, the bullets have to be kept in a pocket or bag, somewhere apart from the firearm, which can be inconvenient.

What is needed, therefore, is a means of holding large caliber bullets in a easy-to-use location on the firearm. What is further needed is an improvement in the appearance of a rifle that uses such large caliber bullets.

BRIEF SUMMARY OF THE INVENTION

The invention is an external ammunition storage device for use with repeating firearms, such as, for example, the BMG50 Sniper Rifle, but also for other types of assault rifles. These types of assault weapons have a lower receiver and a detachable ammunition magazine that snaps into the lower receiver. The detachable magazine is adapted to load a particular caliber bullet and to snap into a particular lower receiver. The .50 caliber bullets are too large for the conventional ammunition magazine and are, therefore, loaded manually into the chamber.

The external storage device according to the invention is a device shaped similar to a conventional ammunition magazine, but in contrast to the conventional ammunition magazine, the external storage device stores bullets on external surfaces that are exposed when the device is inserted into the lower receive of the firearm. When sized for large caliber bullets, such as for .50 caliber bullets, the external storage device is a sleeve that carries bullets on its outer surfaces, but is empty on the inside. The device snaps into the lower receiver in a manner similar to that of the conventional ammunition magazine, but the bullets are on the outside and, thus, are not loaded automatically from the magazine into the firearm. The device is modified compared to the conventional ammunition magazine, so that it does not interfere with the bolt action of the firearm. Rather, the user manually removes the bullets from the storage device and inserts them into the chamber in the firearm. When sized for smaller caliber bullets, the external storage device may be used in the conventional manner, that is, with the bullets loaded into the magazine and automatically fed into the firearm. In this case, the bullets are mounted in the external storage on the outside of the magazine for aesthetic reasons and for additional storage.

The advantages of the external storage device according to the invention are at least twofold: one, the device holds the bullets in a readily accessible location and two, improves the aesthetic look of the firearm. Indeed, the appearance of large caliber bullets on the outside of the ammunition magazine underscores the powerful image of the firearm.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1A:
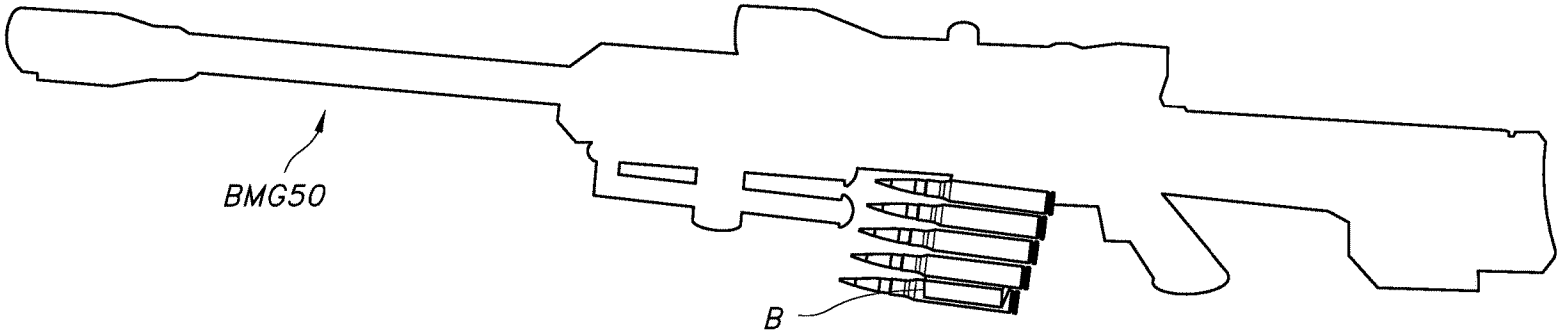
FIG. 1A illustrates a .50 caliber sniper rifle with an external storage device according to the invention, showing .50 caliber bullets in the external storage.
Figure 1B:
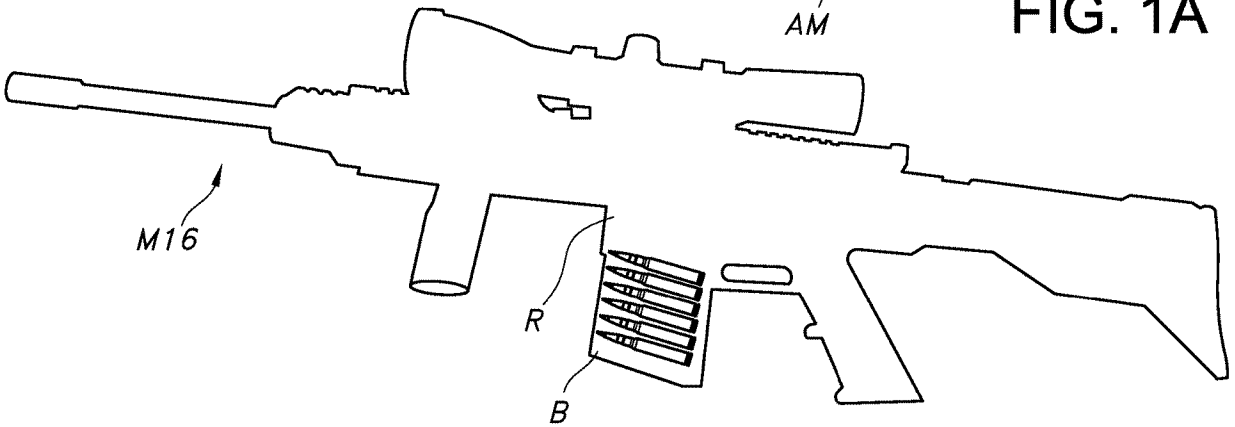
FIG. 1B illustrates M16 caliber rifle, with the external storage device according to the invention, showing M16 bullets in the external storage.

FIGS. 1A and 1B illustrate BMG50 and the M16 assault rifles, each showing a conventional ammunition magazine AM with bullets B arranged on the outer surfaces, for illustration purposes. The ammunition magazine AM snaps into a lower receiver R on the rifle.

Figure 2:
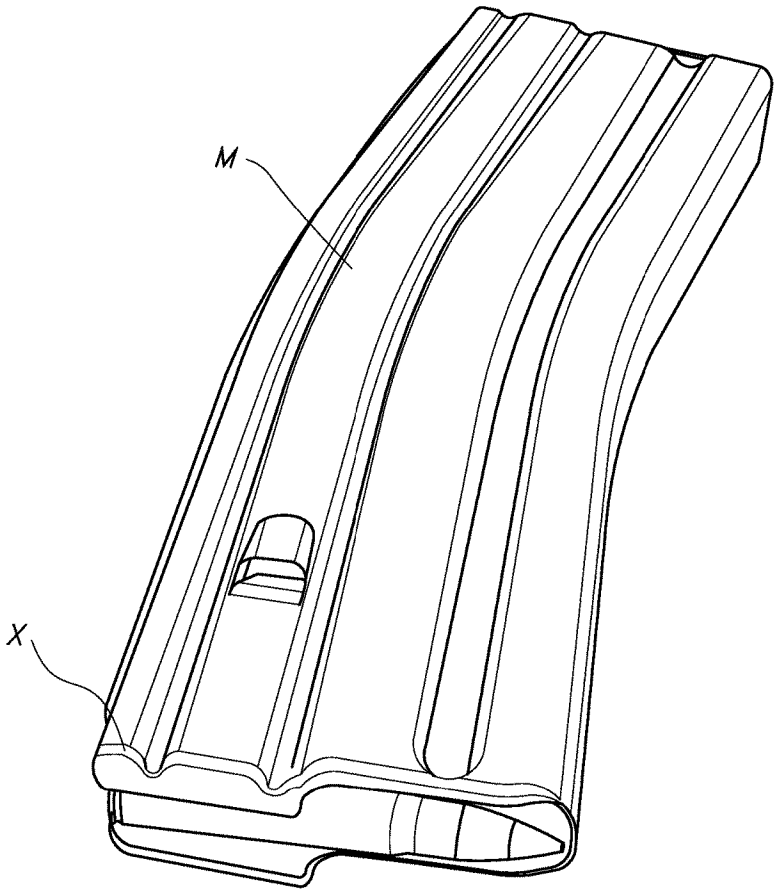
FIG. 2 shows a conventional .233 ammunition magazine, loaded with bullets.

FIG. 2 shows a conventional ammunition magazine for an M16 rifle.

Figure 4:
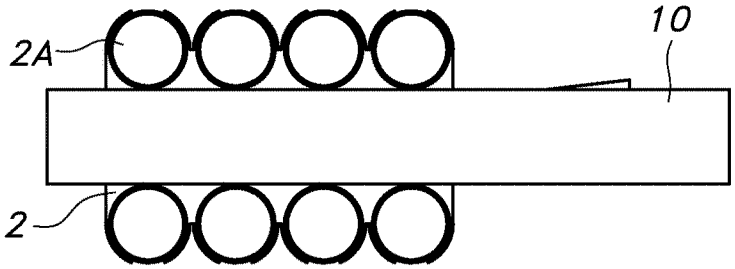
FIG. 4 illustrates a side plane view of the external storage device, without bullets, showing the arrangement of storage slots on the outside surface of the device.
Figure 3:
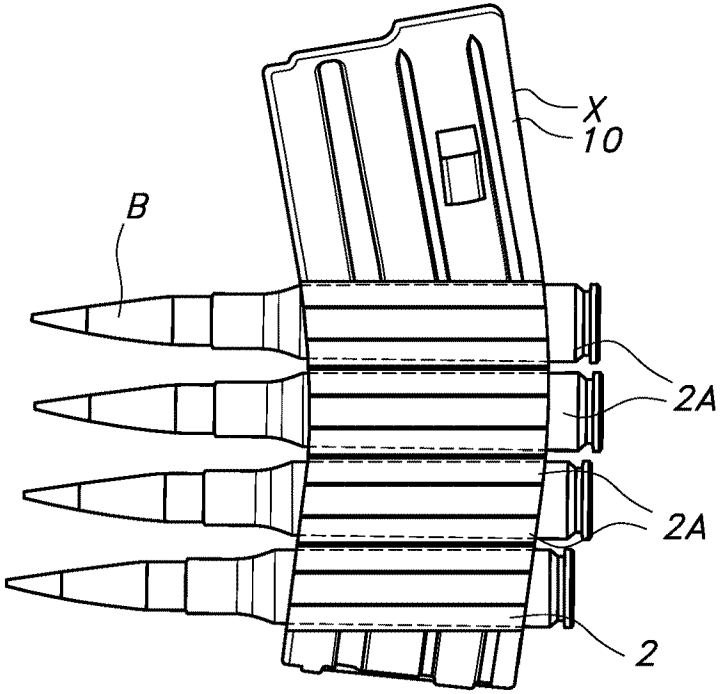
FIG. 3 illustrates a front plane view of the external storage device according to the invention, constructed for .50 caliber bullets and with bullets inserted into storage slots.

FIGS. 3 and 4 illustrate an external storage device 10 according to the invention, with bullets B snapped into an external bullet storage 2. Individual slots 2A are provided on surfaces of the external storage device 10 that are exposed when the device is inserted into a firearm. Each slot 2A releasably holds a bullet. In the embodiment shown in these two figures, the external storage device 10 is constructed to store .50 caliber bullets. These bullets are very large and there is currently no ammunition magazine sized for .50 caliber bullets. As a result, the bullets are typically carried on the person of the firearm user, in pockets or satchels, etc. There is an aesthetic appeal to having the bullets held in the external storage device 10, because they are then very visible and enhance the very powerful image of the firearm.

The external storage device 10 according to the invention may be constructed as a molded plastic component, the upper portion of which is designed to snap into the lower receiver of a conventional assault rifle. In other words, the coupling portion of the molded plastic component is designed to correspond to the coupling end of a particular conventional ammunition magazine.

In the embodiment shown in FIGS. 3 and 4, the individual slots 2A are formed by curved arms that are slightly flexible, so that the bullet may be snapped or slid into and out of the slot. The technology underlying such molded plastic devices is extremely well known and is therefore not described in greater detail herein. It is also within the scope of the invention to provide other types of molded plastic storage elements, which may differ in structural features, but provide a releasable hold on a bullet. For example, the individual slots 2A may be formed as open-ended tubes, into which the bullets are slid and held in place by an interference or friction fit. Ideally, a good portion of the bullet remains visible beyond the individual slot.

Figure 6:
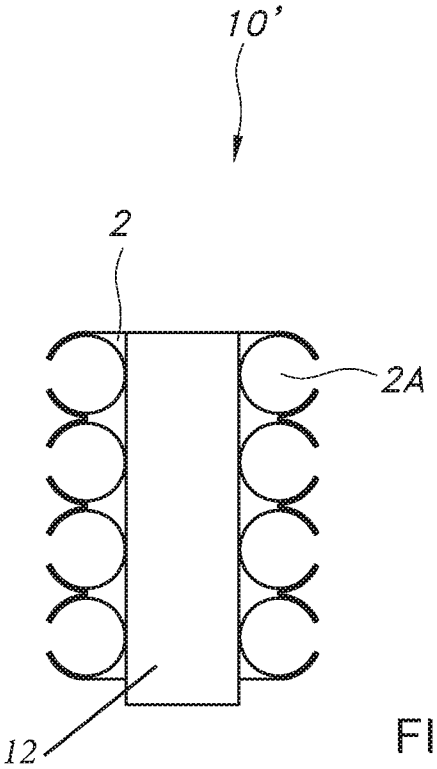
FIG. 6 is a top plan view of the sleeve of FIG. 5.
Figure 5:
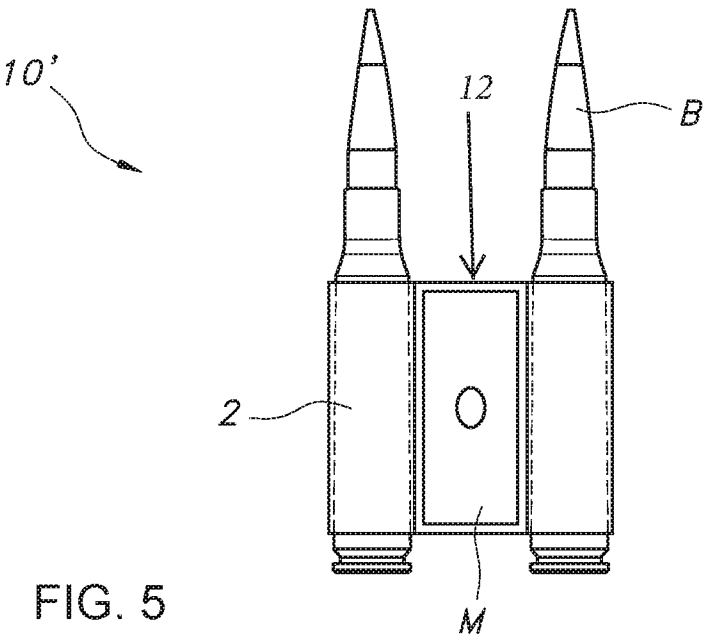
FIG. 5 is a side elevation view of a sleeve for use with a conventional ammunition magazine.

It is also possible to use a conventional ammunition magazine to snap into the receiver and to provide an external storage device according to the invention that is constructed as a sleeve 10' with the external bullet storage 2, the sleeve 10' sliding over the magazine. FIGS. 5 and 6 illustrate such a sleeve 10'. The sleeve has an opening 12 that is dimensioned to fit over a conventional ammunition magazine. The sleeve 10' may be fastened to the bottom of the ammunition magazine by means of a threaded fastener or some other easy-to-use fastener, may be adhesively affixed to the ammo magazine, or may have a friction or interference fit with the ammo magazine.

When using a conventional ammunition magazine with the sleeve 10' or when constructing a plastic molded component that will replace the conventional ammunition magazine, either one to be used with .50 caliber bullets, the portion identified as X in FIGS. 2 and 3 needs to be eliminated, so that the clip does not interfere with the bolt action. The portion can simply be sawed off on the conventional ammunition magazine. When preparing a mold to make a molded component, the portion will simply be eliminated.

Due to the desirable visual aesthetics of having the bullets show on the outside of an ammunition magazine, the external storage device 10 according to the invention with the external bullet storage 2 may be provided for bullets that are actually also loaded into an ammunition magazine and fed automatically into the firearm. FIG. 1A illustrates how bullets may be stored on the outside of an ammunition magazine. FIG. 3-6 illustrate the external storage device 10 with external bullet storage 2 sized to hold .50 caliber bullets. It is understood, however, that the external bullet storage feature may be adapted to accommodate a particular size bullet, other than the .50 caliber, for example, .223 caliber bullets. In this case, the internal dimensions and the coupling end of the external storage device 10 will correspond in shape and structure to the conventional ammunition magazine for the particular caliber bullet, but will also have the external bullet storage 2, be it as a sleeve 10' or as an ammunition magazine with the external bullet storage 2 integrated into its structure, to hold bullets, for the aesthetic appeal.

It is understood that the embodiments described herein are merely illustrative of the present invention. Variations in the construction of the external storage device with external bullet storage may be contemplated by one skilled in the art without limiting the intended scope of the invention herein disclosed and as defined by the following claims.

What is claimed is:

1. An external storage device for use with a repeating firearm that has a lower receiver and an ammunition magazine, the ammunition magazine having an upper end and a lower end, the upper end being insertable into the lower receiver, the external storage device comprising:

a sleeve that is dimensioned to mount on the ammunition magazine and frictionally secure to the ammunition magazine;

and a plurality of external bullet holders having length dimensions provided on outer surfaces of the sleeve, each bullet holder being a tube having a diameter that is dimensioned to receive and hold a bullet that has a bullet diameter and a bullet length;

wherein each external bullet holder holds only one bullet;

wherein the length dimension of each bullet holder is shorter than the bullet length, such that at least some portion of each bullet extends beyond the length dimensions of the external bullet holder;

wherein each bullet is manually removable from the holder for insertion into the firearm; and wherein the firearm and the ammunition magazine are operational while the sleeve is on the ammunition magazine.

2. The external storage device of claim 1, wherein the sleeve is a molded component and the external bullet holders are integrated into the molded sleeve.

3. The external storage device of claim 2, wherein the plurality of bullet holders are formed as slots having a C-shape, each slot providing a snap-fit hold for a bullet wherein the bullet and the bullet holder are in physical contact with one another.

4. The external storage device of claim 2, wherein the plurality of bullet holders are formed as open-ended tubes, each tube providing an interference fit to securely hold a bullet and wherein the bullet and the bullet holder are in physical contact with one another.

5. An external bullet storage system for use with a repeating firearm that has a lower receiver, the system comprising:

an ammunition magazine that is insertable into the lower receiver; and an external bullet storage device that is mounted on and frictionally secured to the ammunition magazine, the external bullet storage device having a plurality of external bullet holders provided on outer surfaces of the external bullet storage device, each bullet holder being a tube having a diameter that is dimensioned to receive and hold a bullet that has a bullet diameter and a bullet length;

wherein each external bullet holder holds just one bullet;

wherein the length dimension of each bullet holder is shorter than the bullet length, such that at least some portion of each bullet extends beyond the length dimension of the external bullet holder;

wherein each bullet is manually removable from the holder for insertion into the firearm; and wherein the firearm and the ammunition magazine are operational while the external bullet storage device is on the ammunition magazine.

* * * * *